US011324341B2

(12) United States Patent
Francis et al.

(10) Patent No.: US 11,324,341 B2
(45) Date of Patent: May 10, 2022

(54) DISPLAY TRAY WITH MODULAR STRUCTURE

(71) Applicants: Roger Francis, Dubai (AE); Dmitrii Viktorovich Budiak, Zvenigorod (RU)

(72) Inventors: Roger Francis, Dubai (AE); Dmitrii Viktorovich Budiak, Zvenigorod (RU)

( * ) Notice: Subject to any disclaimer, the term of this patent is extended or adjusted under 35 U.S.C. 154(b) by 50 days.

(21) Appl. No.: 17/047,381

(22) PCT Filed: Apr. 12, 2019

(86) PCT No.: PCT/RU2019/000240

§ 371 (c)(1),
(2) Date: May 5, 2021

(87) PCT Pub. No.: WO2019/216790

PCT Pub. Date: Nov. 14, 2019

(65) Prior Publication Data

US 2022/0000281 A1 Jan. 6, 2022

(30) Foreign Application Priority Data

May 7, 2018 (RU) ..... RU2018116888

(51) Int. Cl.
*A47F 5/00* (2006.01)
*A47B 87/02* (2006.01)
(Continued)

(52) U.S. Cl.
CPC ..... *A47F 3/142* (2013.01); *A47F 3/14* (2013.01); *A47F 5/0018* (2013.01); *A47F 5/0025* (2013.01); *A47F 1/12* (2013.01)

(58) Field of Classification Search
CPC ..... A47F 3/142; A47F 3/14; A47F 5/0018; A47F 5/0025; A47F 1/12
See application file for complete search history.

(56) References Cited

U.S. PATENT DOCUMENTS 2,320,388 A * 6/1943 Shaw ..... B65D 21/0212 206/509
4,006,824 A * 2/1977 Snediker ..... A47F 1/04 312/45

(Continued)

FOREIGN PATENT DOCUMENTS

GB 2446368 A * 8/2008 ..... A47F 5/0018
WO WO-2015161875 A1 * 10/2015 ..... A47B 87/0276

*Primary Examiner* — Kimberley S Wright
(74) *Attorney, Agent, or Firm* — Inventa Capital PLC

(57) ABSTRACT

The invention relates to display equipment and is directed toward providing greater variety in terms of converting a tray. The present tray comprises a base consisting of a flat rectangular bottom delimited by a front wall and a rear wall, which are disposed perpendicular to the upper surface of the bottom, and legs disposed on the lower surface of the bottom, close to the back wall of the base, and further comprises removable vertical side walls. The legs are configured in the form of hollow parallelepipeds, the bottoms of the legs are cut away at an acute angle to the longitudinal axes of the parallelepipeds, causing the base to be inclined, the top of the rear wall of the base is provided with two triangular protuberances, the distance between which coincides with the distance between the inner surfaces of the cavities of the legs, the rear sides of the triangular protuberances are parallel to the axes of the legs, and the left and right edges of the base of the tray are provided with fastening elements. The legs of a tray and the top of the rear wall of a base equipped with triangular protuberances are provided with elements for the mutual fastening thereof.

12 Claims, 10 Drawing Sheets

(51) Int. Cl.
*A47F 3/14* (2006.01)
*A47F 1/12* (2006.01)

(56) References Cited

U.S. PATENT DOCUMENTS 4,423,818 A * 1/1984 Spamer ..... A47F 1/12
193/38
2004/0217077 A1* 11/2004 Gerstner ..... A47F 3/004
211/59.3
2007/0257053 A1* 11/2007 Silveria ..... A47F 5/10
221/194

* cited by examiner

DISPLAY TRAY WITH MODULAR STRUCTURE

The invention pertains to equipment intended for use in shopping premises for displaying, storing and selling a wide range of small piece-goods, for example, chocolates, cookies, chewing gum, sweets.

The closest to the proposed invention is a modular demonstration tray, consisting of a mounting base, vertical walls and a vertical panel, provided that the rear wall of the tray has a through groove designed for installing a vertical panel narrowing upward with bent edges forming the side walls, each of which has a projection, and also the height of each section of the side wall uniformly decreases along the length; the vertical panel is equipped with a stop limiting its movement in the groove of the rear wall of the tray in which it is installed, as well as elements of mutual fixing with each other to form a vertical modular structure (RF patent for utility model No. 30525)

Holes are made along the edges of the panel designed for trays hanging. At least one vertical wall of the tray has a hole at the bottom designed for fixing the tray to a horizontal surface.

On the side walls of the mounting base, fixation elements are made for fixating at least one tray adjacent thereto to form a horizontal modular structure. The tray is made of a transparent material. The disadvantages of the known tray are: the impossibility of transforming the storage space when the assortment of goods changes, the impossibility of automatic feeding the goods to the zone most convenient for their taking out by the buyer.

SUBSTANCE OF INVENTION

The technical result of the invention consists in expanding the functionality of the tray for goods storing and displaying by making it possible to transform the goods storage space in case the assortment changes, providing for automatic goods feeding to the area most convenient for their taking out by the buyer, ensuring the best visibility of the goods and information about the goods, enabling quick replacement of information about the goods and the manufacturer.

The said technical result is achieved by the fact that the tray of the modular demonstration device includes the mounting base, consisting of a flat right-angular bottom, defined by the front and the rear walls located perpendicular to its upper surface, and legs located on the lower surface of the bottom near the rear wall of the mounting base, removable vertical side walls, provided that the legs are made in the form of hollow parallelepipeds, the lower part of the legs is cut off at an acute angle defining the inclination of the mounting base to the long axes of the parallelepipeds, the upper part of the rear wall of the base is fitted with two triangular projections, the distance between which coincides with the distance between the inner surfaces of the cavities of the leg, the rear sides of the triangular projections are parallel to the axes of the legs, the left and the right edges of the tray mounting base are equipped with fixation elements for side walls installing on the mounting base and for horizontally fastening together at least two adjacent tray mounting bases to form a horizontal modular structure, and the legs of the tray and the upper part of the rear wall of the mounting base with triangular projections are fitted with elements of mutual fixation to each other to form a vertical modular structure. The said technical result is also achieved by the fact that narrow slots are made in the central part of the bottom of the mounting base, and ribs are made on the inner side of the front and rear walls of the mounting base, provided that the width and the position of the clearances between the ribs correspond to the width of the slots in the bottom of the mounting base and their position so that the flat dividers with projections in the lower part can be inserted into them and fixed by these projections in the slots in the central part of the bottom of the mounting base.

The said technical result is also achieved by the fact that a hole is made in the rare wall of the tray for tray hanging. The said technical result is also achieved by the fact that the inner-face of the right side wall of the tray is equipped with projections matching the shape of the grooves and notches in the right edge of the mounting base and meshing with these grooves and notches. The said technical result is also achieved by the fact that the inner-face of the left side wall of the tray is equipped with projections, grooves, and notches matching the shape of the grooves and notches in the left edge of the mounting base and meshing with these grooves and notches. The said technical result is also achieved by the fact that on the outside, the side walls of the tray are equipped with ribs and are closed with covers matching the shape of the side walls of the tray and made of transparent material.

The said technical result is also achieved by the fact that for interlocking of at least two trays to form a vertical modular structure, two projections are made on the rear sides of the triangular projections, matching to the shape and the size of the grooves on the lower part of the rear side of the leg, and facing surfaces of the triangular projections at the upper part of the rear wall are equipped with the spring-loaded circular clamps, matching the size of the circular holes on the facing surfaces of the parallelepipeds of the legs. The said technical result is also achieved by the fact that, in addition it has a head piece consisting of two hollow prisms connected by a wall on the side facing the front wall of the tray mounting base, and having cutouts on the inner sides of the prisms, matching the spring-loaded circular clamps on the triangular projections of the rear wall of the mounting base.

The said technical result is also achieved by the fact that, additionally, the front wall of the tray has a cover pivotally connected with the mounting base of the tray. The said technical result is also achieved by the fact that the cover to the front wall of the tray is made with a transparent material. The said technical result is also achieved by the fact that the front and the rare walls are equipped with the vertical reinforcement ribs on the outside. The said technical result is also achieved by the fact that, in addition, it is equipped with lighting. Embodiments of the invention

SUBSTANCE OF INVENTION IS CLARIFIED BY THE DRAWINGS IN WHICH

Figure 1:
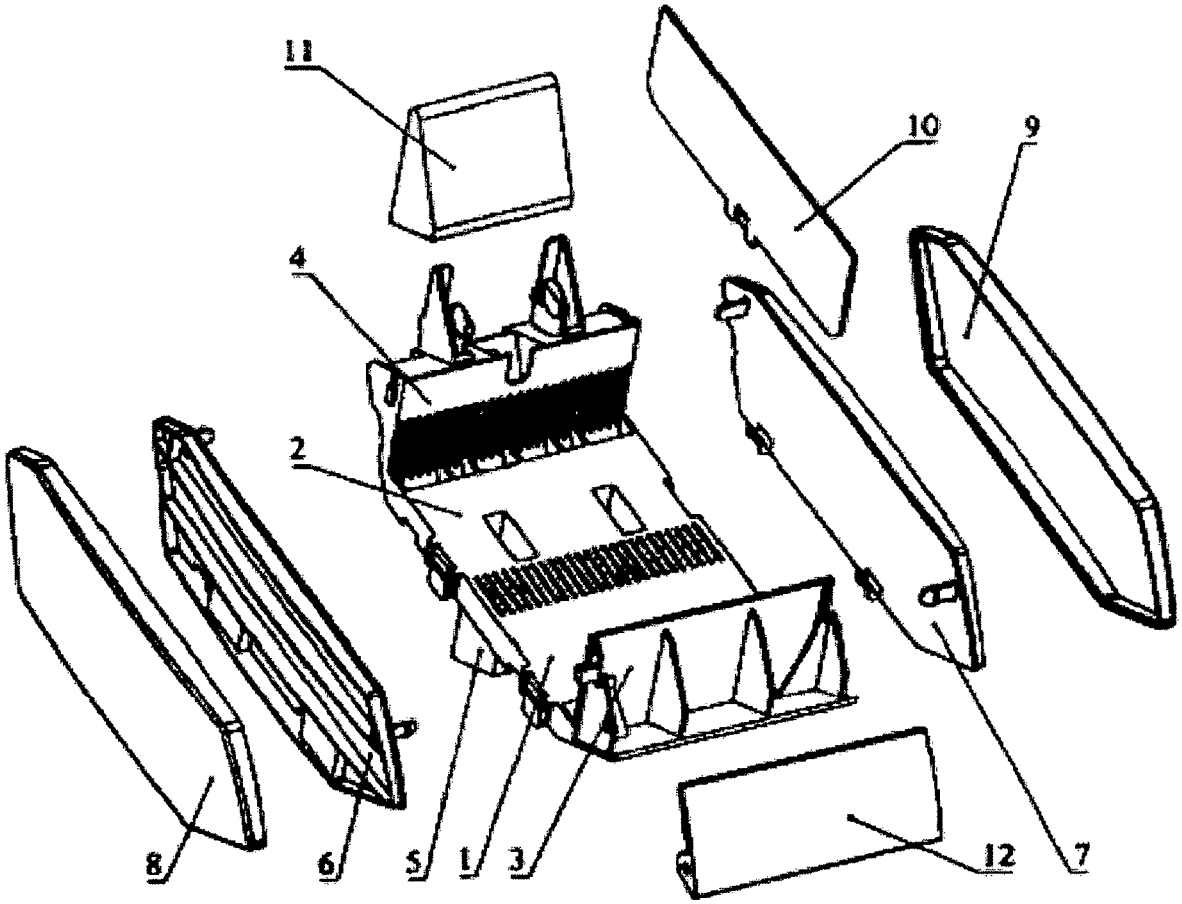
FIG. 1 shows a general view of the tray in the disassembled condition

The following symbols are used in the drawings presented: 1—mounting base of the tray, consisting of bottom 2, front wall 3, rare wall 4 and leg 5; 6—left side wall; 7—right side wall; 8—left cover; 9—right cover; 10—divider; 11—head piece onto the rare wall; 12—head piece onto the front wall, 13—triangular projections on the rare wall; 14—spring-loaded circular clamps; 15—slots in the central part of the mounting base bottom 2; 16—ribs on the inner side of the rare wall of the mounting base; 17—reinforcement ribs on the external side of the front wall; 18—projection on the rare surfaces of the triangular projections 13; 19 and 20—projections on the left side edge of the rare and the front walls respectively; 21 and 22—grooves on the left side edge of the rare and the front walls, respectively; 23 and 24—spring-loaded clamps on the left side edge of the mounting base bottom; 25 and 26—notches on the left side edge of the mounting base bottom; 27—ribs on the inner side of the front mounting base wall; 28—reinforcement ribs on the outer side of the rare wall; 29—circular holes on the facing surfaces of the legs 5; 30—grooves on the rare planes of the legs 5; 31 and 32—grooves on the right side plane of the rare and the front walls, respectively; 33 and 34—notches on the right side edge of the mounting base bottom; 35 and 36—groves on the right side edge of the mounting base bottom; 37 and 38—projections located at the bottom in the form of upward facing flat hooks; 39 and 40—hollows; 41 and 42—projections at the top of the wall, grooves 43 and 44 located adjacent thereto; 45 and 46—projections in the form of upward facing flat hooks, located at the bottom; 47 and 48—projections at the top of the wall; 49—hollow prismas, connected by wall 50; 51—notches on the inner sides of prisms 49, matching the spring-loaded circular clamps 14 on the triangular projections.

Modular demonstration tray (FIG. 1) consists of: mounting base 1 consisting of bottom 2, front wall 3, rare wall 4 and legs 5; two side walls the left 6 and the right 7 with matching covers 8 and 9, 10—divider, 11—head piece on the rare wall; 12—front wall cover.

Figure 2:
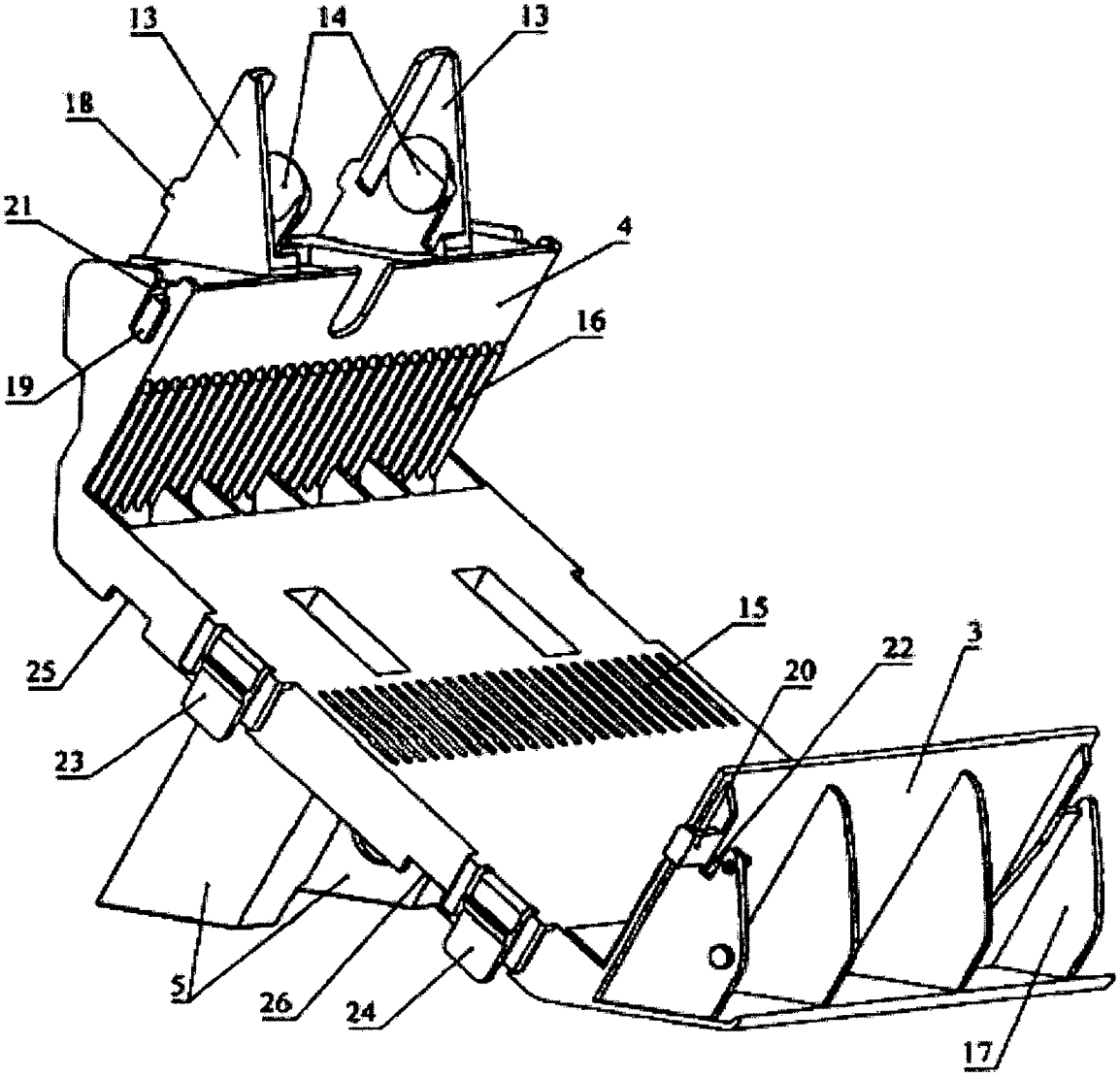
FIG. 2 and FIG. 3 show the left view of the tray mounting base from various perspectives.
Figure 3:
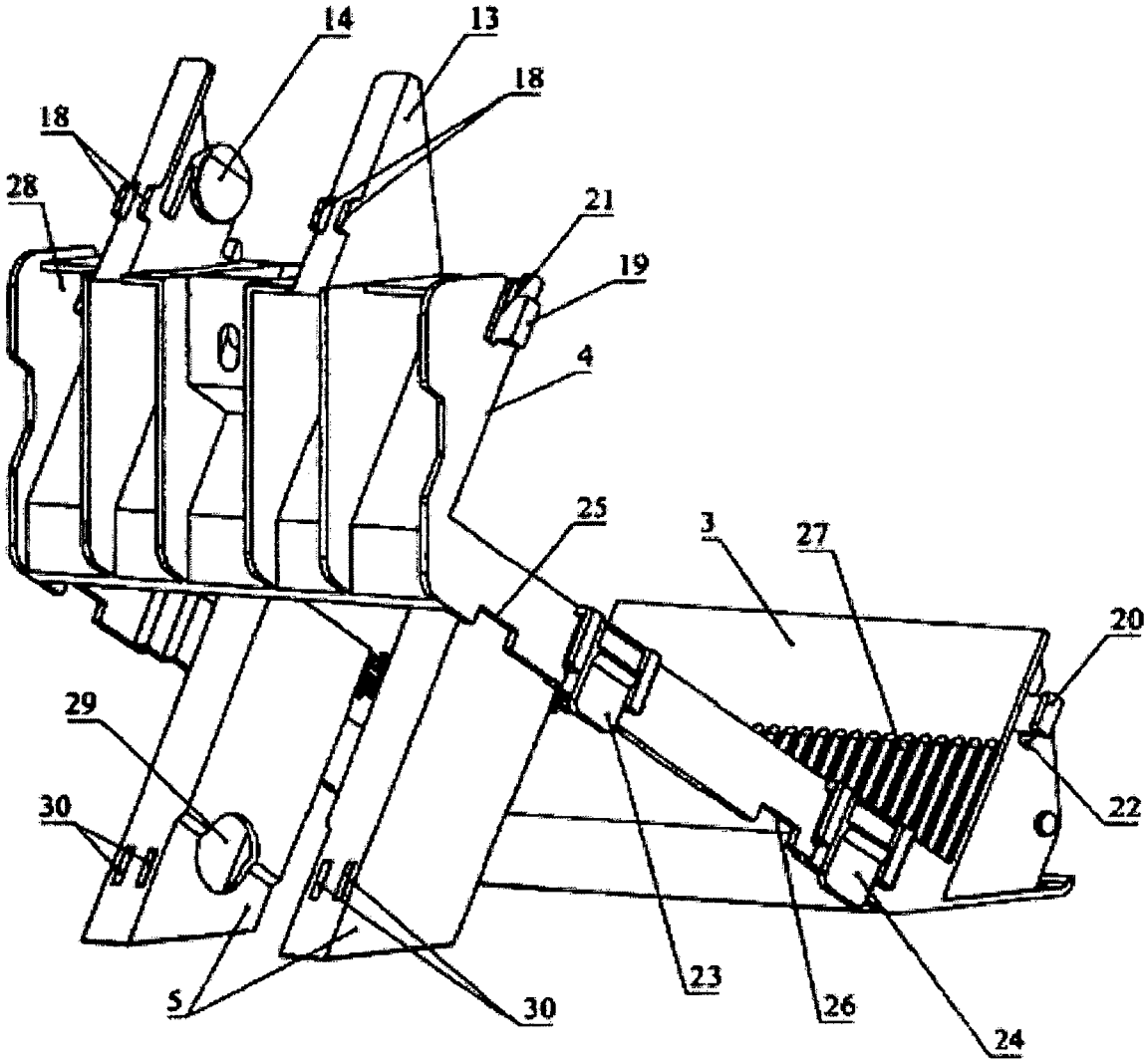
Figure 4:
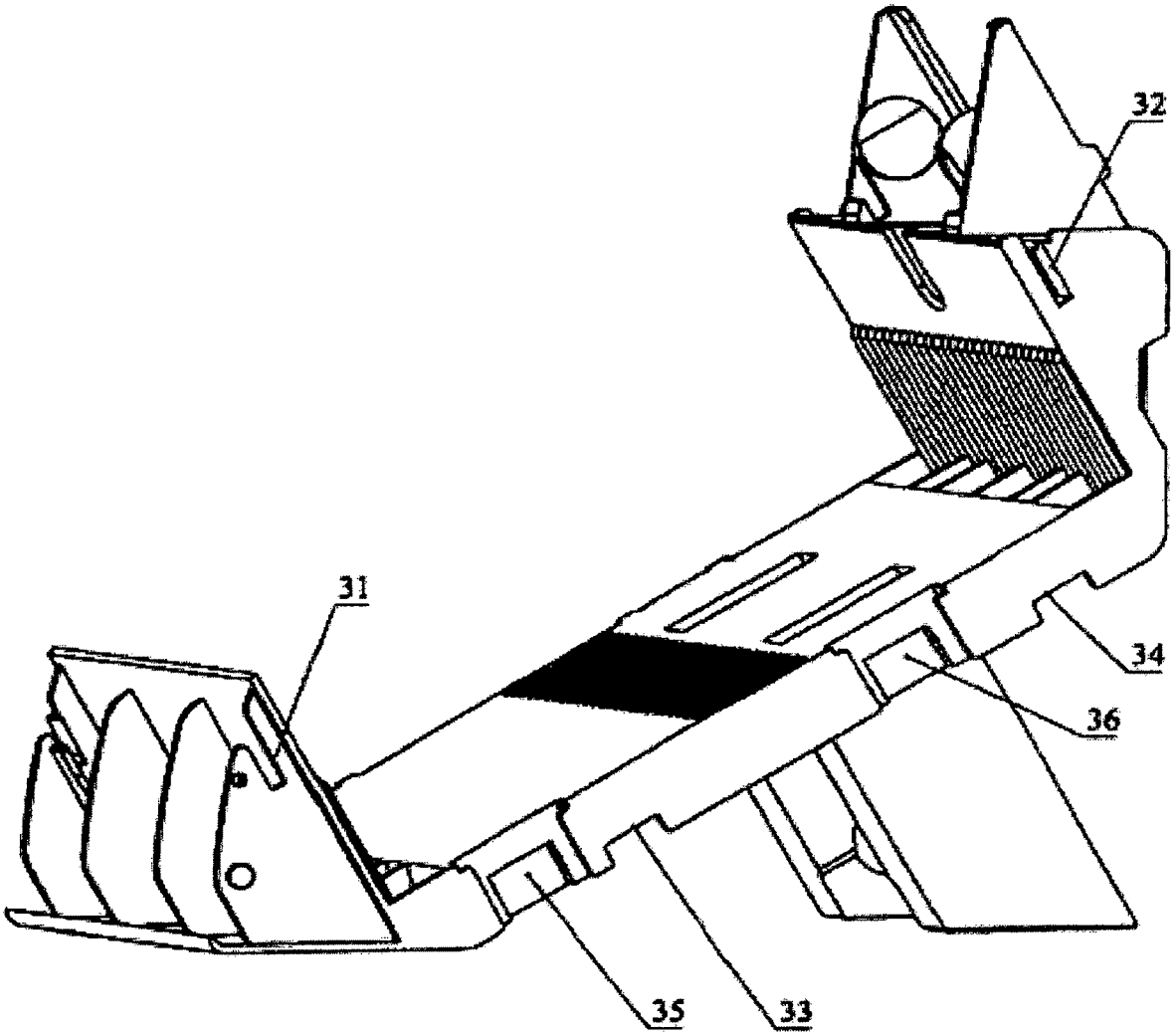
FIG. 4 shows the right view of the tray.

Mounting base 1 of the tray (FIG. 2 and FIG. 3) is made in the form of an inclined flat rectangular bottom 2, defined by front 3 and rear 4 walls, located perpendicular to the plane of bottom 2. On the lower surface 2 of the bottom of mounting base 1, as viewed from the side of rear wall 4, legs 5 are provided, located perpendicular to the surface of bottom 2 and made in the form of hollow parallelepipeds. The lower part of legs 5 is cut at an acute angle to the long axes of the parallelepipeds, which sets the angle of inclination of bottom 2. Circular holes 29 are made in the facing surfaces of legs 5; rectangular grooves—in the rare sides of the legs.

At the top of rare wall 4 of bottom 1, two triangular projections 13 are made; the distance between which matches the distance between the hollows of legs 5; the rare sides of triangular projections 13 are parallel to the rare sides of legs 5. On the rare surfaces of triangular projections 13, rectangular projections 18 are made, the shape, location and size of which match to that of notches 30 on the rare side of legs 5, and, on the facing surfaces of triangular projections 13, spring-loaded circular clamps 14 are made matching to the size of circular holes 29 on the facing surfaces of the parallelepipeds of legs 5, thus enabling to connect at least 2 trays vertically to form a vertical modular structure.

The side edges of the tray mounting base are equipped with the fixation elements enabling to attach the side walls to the mounting base and interlock at least two adjacent tray mounting bases to form a horizontal modular structure.

On the left side edge of mounting base 1, the following fixation elements are located: projections 19 and 20 on the left side edge of rear 4 and front 3 walls, grooves 21 and 22 on the left side edge of the rear and the front walls, spring-loaded clamps 23 and 24 on the left side edge of the bottom of the mounting base, notches 25 and 26 on the left side edge of the mounting base bottom.

The following fixation elements are located on the right side edge of mounting base 1: grooves 31 and 32 on the right side edge of the rear and the front walls, notches 33 and 34 and grooves 35 and 36 on the right side edge of the mounting base bottom, matching to the fixation elements on the left side edge of the adjacent tray, thus enabling to connect several trays in a horizontal modular structure.

Figure 5:
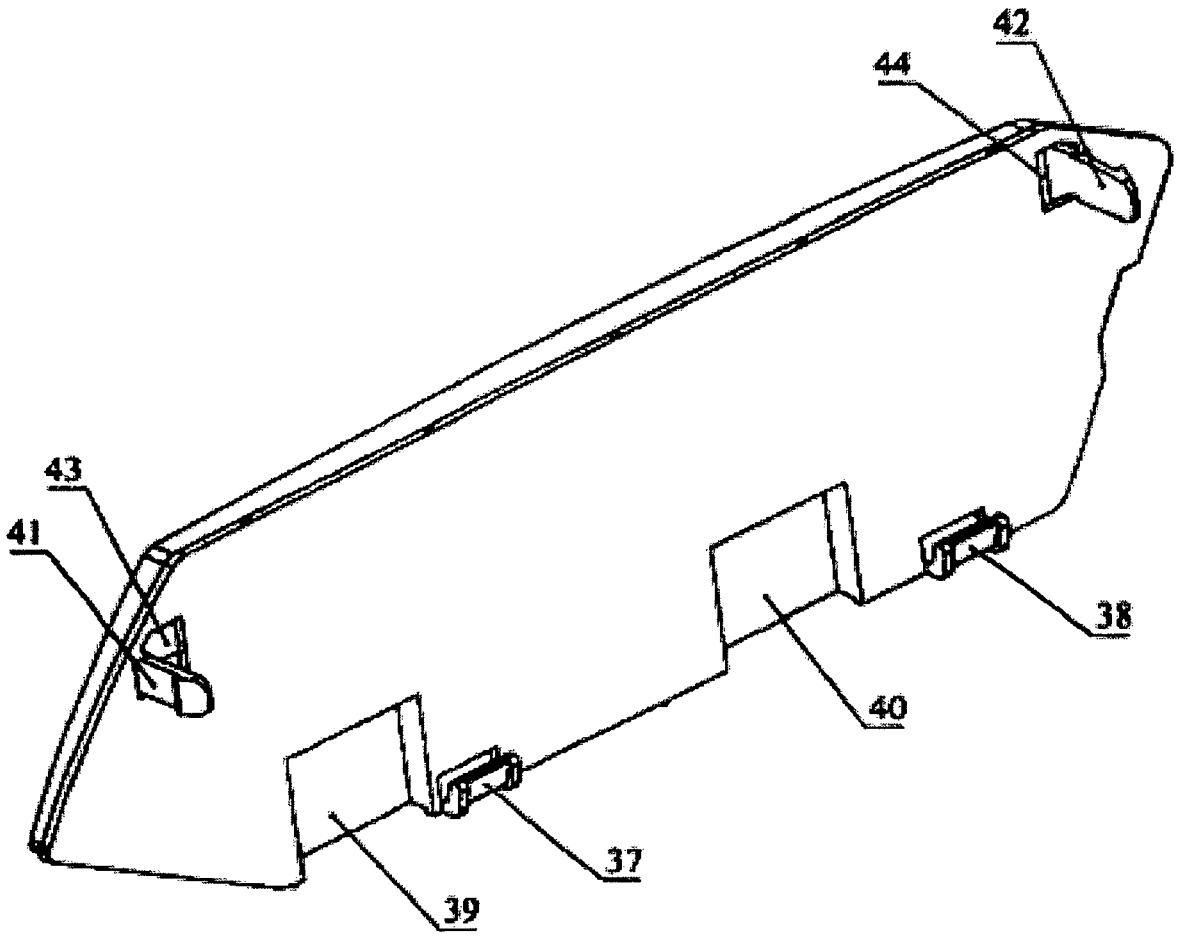
FIG. 5 shows the view of the left side wall of the tray on the inside.

The left side wall 6 of the tray (FIG. 5) on the side facing mounting base 1 of the tray is equipped with projections located at the bottom in the form of upwardly facing flat hooks 37 and 38, rectangular hollows 39 and 40, and, at the top—with projections 41 and 42 and rectangular grooves 43 and 44 located next to these projections, the shape and location of which match to notches 25 and 26, spring-loaded clamps 23 and 24, grooves 21 and 22 and projections 19 and 20 on the left side edge of the mounting base and meshing with these notches, latches, grooves, projections.

Figure 6:
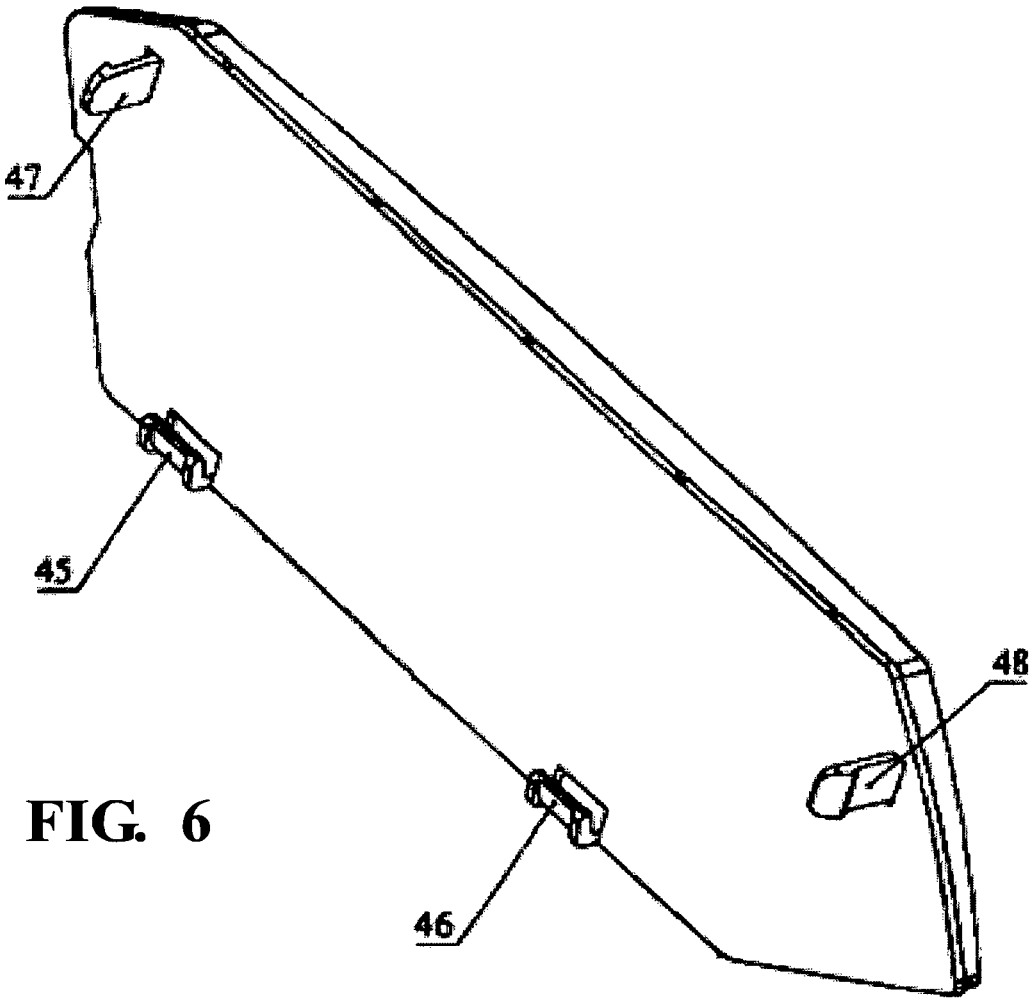
FIG. 6 shows the view of the right side wall of the tray on the inside.

The right side wall 7 of the tray (FIG. 6) on the side facing mounting base 1 of the tray is equipped with projections located at the bottom in the form of upwardly facing flat hooks 45 and 46, and, at the top—with projections 47 and 48 the shape and location of which match to notches 33 and 34, grooves 31 and 32 on the right side edge of the mounting base, and meshing with these notches and grooves.

On the outside, fray side walls 6 and 7 equipped with ribs are closed with covers 8 and 9 matching to the tray side walls and made with a transparent material.

In the central part of bottom 2 of mounting base 1, narrow slots 15 are made, and on the inner side of front 3 and rear 4 walls of mounting base 1, ribs 27 and 16 are made, provided that the clearances between the ribs as to their width and position match to slots 15 in bottom 2 of mounting base 1 in such a way that a flat divider 10 is inserted thereto, the projection in the bottom of which is fixed in slot 15 in the central part of bottom 2, and the ends of divider 10—in the corresponding clearance between ribs 27 and 16.

Figure 7:
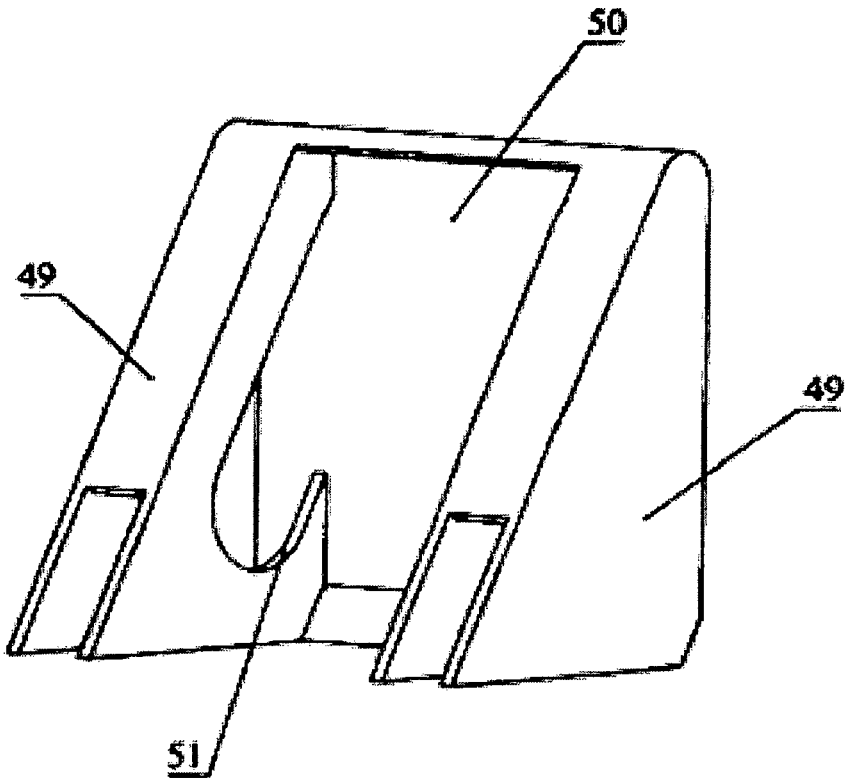
FIG. 7 shows head piece 11 to the rare wall of the tray.

The upper part of rare wall 4 of mounting base 1 may be covered by head piece 11 from the top (FIG. 7) made in the form of two hollow prisms 49 connected by bridge 50 on the side facing front wall 3 of mounting base 1 and having notches 29 at the internal sides of prisms 49 matching spring-loaded circular clamps 14 on triangular projections 13.

Front wall 3 of mounting base 1 of the tray is closed with cover 12 made of a transparent material and pivotally connected with the tray mounting base from the outside.

To assemble the tray, left 6 and right 7 vertical walls are placed onto mounting base 1 of the tray at the right and left sides, respectively.

For this purpose, the projections located at the bottom of left side wall 6 in the form of upwardly facing flat hooks 37 and 38 and rectangular hollows 39 and 40 and projections 41 and 42 located at the top of left wall 6 and rectangular grooves 43 and 44 adjacent to these projections are thrown into mesh with matching (in form and position) notches 25 and 26, spring-loaded latches 23 and 24, grooves 21 and 22 and projections 19 and 20 on the left side edge of mounting base 1, and projections 45 and 46 located at the bottom on the right side wall 7 in the form of upward-facing flat hooks and projections 47 and 48 located at the top of right wall 7 are thrown into mesh with matching notches 33 and 34 and grooves 31 and 32 on the right side edge of tray mounting base 1.

Figure 8:
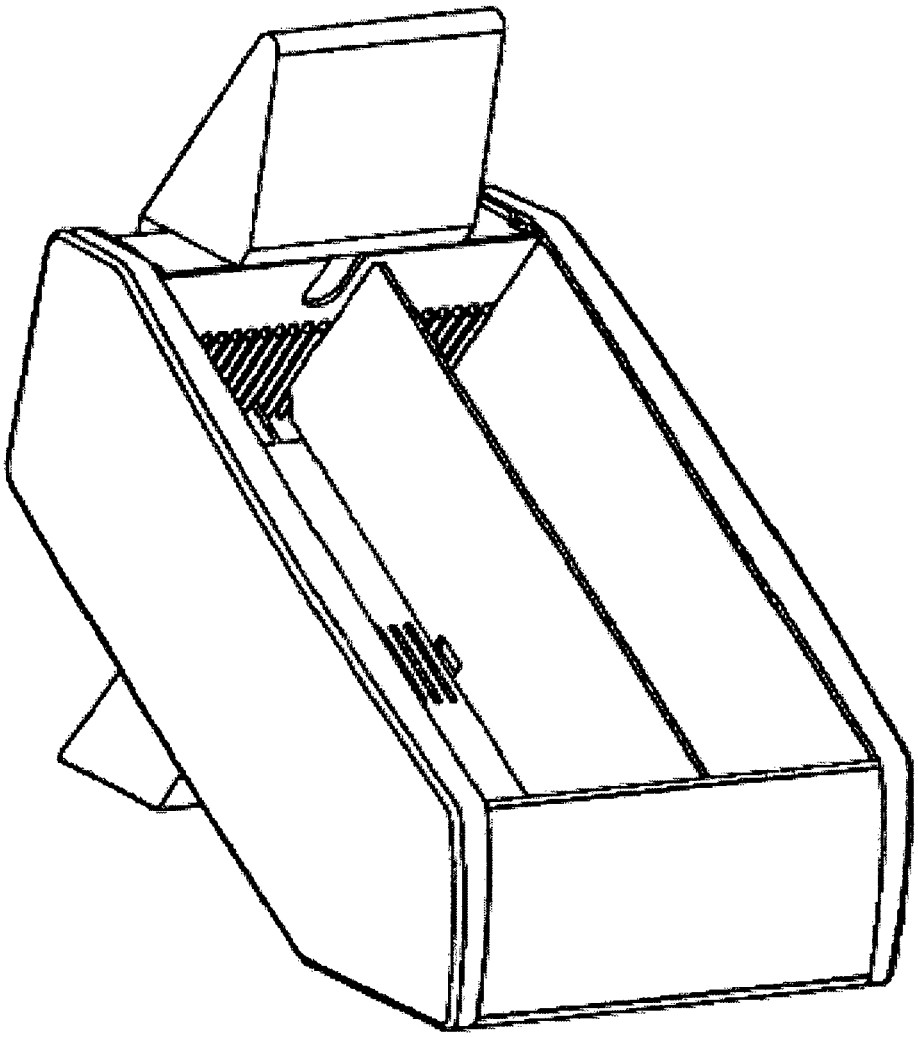
FIG. 8 shows a general view of the tray in the assembled condition
Figure 9:
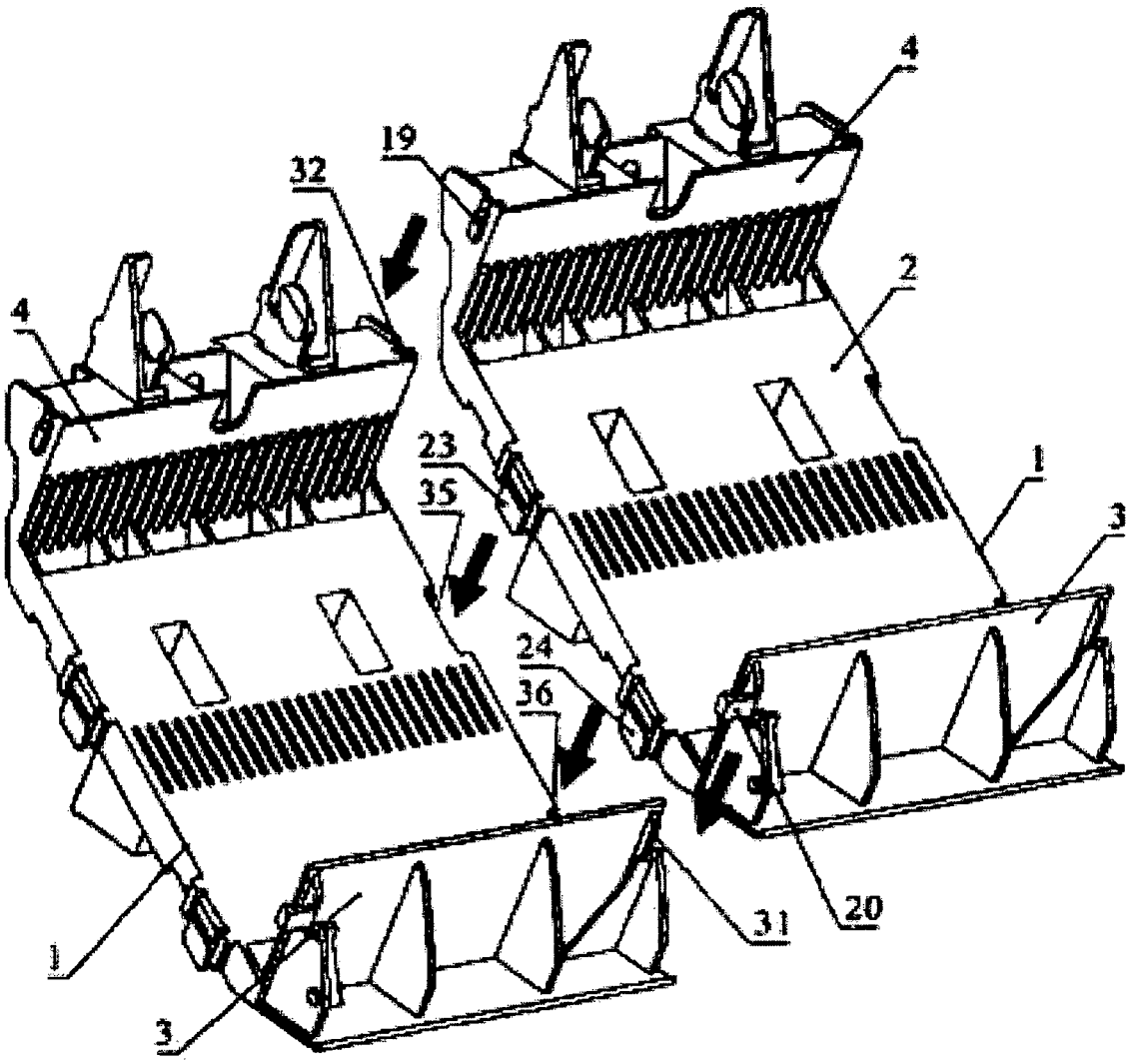
FIG. 9 shows the diagram of horizontal connection of tray mounting bases.

The tray (FIG. 8), with its inclined bottom 2, front 3 and rare 4 walls of mounting base 1 together with left 6 and right 7 vertical side walls forms the space for goods storage.

This space may be divided with divider 10 into two parts, providing for separation of the goods of different assortment, provided that divider 10 may be installed at various distances from left 6 or right 7 side walls. The space may be divided into more than two parts if using additional dividers 10.

The inclined bottom of the mounting base provides for automatic goods feeding to the front wall area under action of gravity. The area adjacent to front wall 3 of the tray is characterized by the best visibility of the product and the convenience of its removal by the buyer.

Side walls 6 and 7 of the tray are closed with covers 8 and 9 made of transparent material. By placing advertising media between the side walls and their covers, which can be made, for example, of paper, thin cardboard or plastic with printed or otherwise applied information, two advertising fields are formed on the left and right sides of the tray. Transparent covers protect the advertising medium against damage when using the tray.

From the outside, the front wall of mounting base 3 of the tray is closed with cover 12 made of a transparent material and pivotally connected with the tray mounting base. In the open position, between front wall 3 of mounting base 1 and cover 12, an advertising medium made of paper, thin cardboard or plastic with printed or otherwise applied information about the product may be placed. When cover 12 is closed, an advertising space appears on front wall 3. Provided that, the advertising medium is protected against any environments with the transparent front cover. The pivotal connection of front cover 12 and front wall 3 of mounting base 1 of the tray allows to quickly change the advertising medium bearing information about the product.

Rear wall 4 of base 1 of the tray at the top is closed with head piece 11, to vertical wall 50 of which a sheet of paper, cardboard, plastic or other material with printed or otherwise applied information about the product or about the manufacturer of the product may be applied using a double-sided adhesive tape, glue, etc.

The present tray can be additionally equipped with elements for illuminating the goods placed therein and the carriers with information about these goods. To do this, at least one LED is to be installed in the front part of the tray (on a special shelf or directly on front wall 3 of the tray mounting base), and electrical contacts are to be fixed on the edges of the tray on the left, on the right, at the top and at the bottom. The LEDs are connected with the contacts using electrical wires. When assembling showcases, adjacent trays are electrically connected with each other, thereby forming an electrical network. Upon connecting a power source to any pair of contacts, the LEDs become powered up and thus turned on. For better light dispersion, a light diffuser made of translucent plastic can be used, which is attached to the mounting base of the tray.

To form a horizontal modular structure, it is necessary to connect the mounting bases of adjacent trays with the side fixation elements. The connection of spring-loaded clamps 23 and 24 on the left side edge of bottom 2 with grooves 35 and 36 on the right side edge of bottom 3 ensures that bottom 2 of mounting bases 1 of the adjacent trays coincide, thus forming a flat surface. Connection of projection 19 with groove 32 ensures alignment of rear walls 4 of the trays, and connection of projection 20 with groove 31 ensures alignment of front walls 3 of the adjacent trays.

Spring-loaded clamps 23 and 24 are designed for preventing unintentional separation of the mounting bases of adjacent trays. They are designed in such a way that, when assembling the mounting bases of the trays, clamps 23 and 24 are bent off without preventing assembling.

To separate the mounting bases of the trays, it is necessary to press on latches 23 and 24 and demesh them and projections 19 and 20 from the corresponding grooves 32, 35, 36, 31, by moving the mounting base of the adjacent trays in relation to each other.

By connecting the mounting bases with one another in the horizontal direction and by connecting the necessary number of other tray elements, it is possible to construct horizontal showcases of different lengths.

To form a vertical modular structure, the hollow parallelepipeds of legs 5 of one tray are to be fit on triangular projections 13 on rear wall 4 of mounting base 1 of the second tray. Rectangular grooves 30 on the rear sides of legs 5 and corresponding rectangular projections 18 on the rear surfaces of triangular projections 13 provide for assembling the mounting bases together in the vertical direction. To ensure tight coupling of adjacent trays in the vertical direction, rigid rectangular projections 18 are provided on the rear surfaces of triangular projections 13 as well as rectangular grooves 30 mating therewith on the rear sides of legs 5, as well as spring-loaded circular clamps 14 on the facing surfaces of triangular projections 13 and round holes (grooves) 29 on the facing surfaces of legs 5 mating therewith, Such combination of elements ensures tight coupling and integrity under exposure to any environmental factors. When assembling, it is necessary to perform a complex translational-rotational movement of one mounting base against the other. To detach the mounting bases, it is necessary to put pressure on spring-loaded circular clamps 14 and perform a reverse complex translational-rotational movement of one mounting base against the other.

By connecting the mounting bases with one another in the vertical direction and by connecting the necessary number of other tray elements, it is possible to construct horizontal showcases of different heights.

Figure 10:
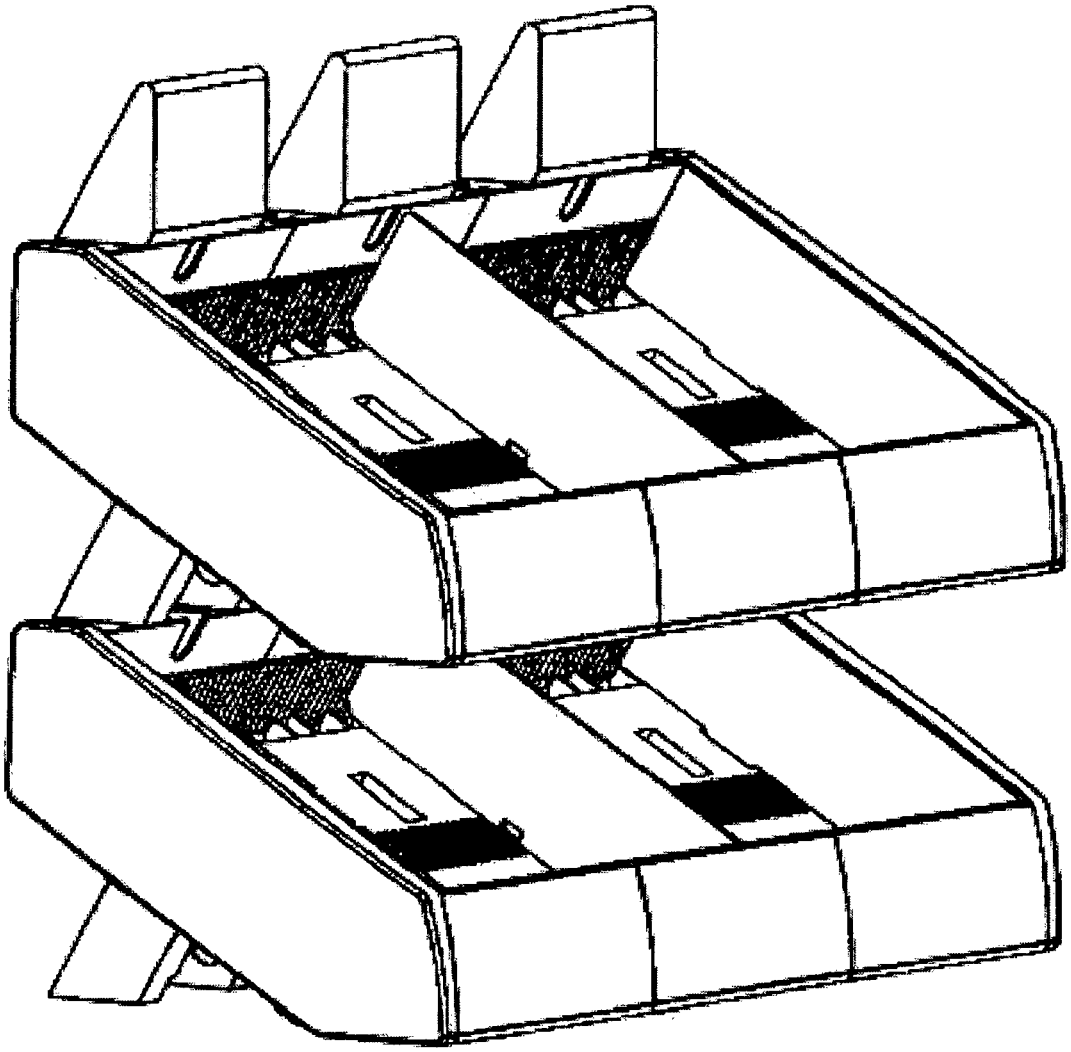
FIG. 10 shows an example of a combined showcase consisting of two similar horizontal showcases of three trays.

The trays may be assembled into a combined showcase by attaching several horizontal showcases against each other in vertical direction. An example of a combined showcase consisting of two similar horizontal showcases consisting of three trays is shown on FIG. 10. By combining various number of mounting bases in the rows and the number of rows, it is possible to construct showcases of different sizes most suitable for each particular trade enterprise. The number of combinations is restricted only by the space allotted for goods placement in the trade enterprise.

INDUSTRIAL APPLICABILITY

The present invention may be used in shopping premises for displaying, storing and selling a wide range of small piece-goods, for example, chocolates, cookies, chewing gum, sweets.

The invention claimed is:

1. A tray of the modular demonstration device including the mounting base comprising:

a flat right-angular bottom, defined by the front and the rear walls located perpendicular to its upper surface, and legs located on the lower surface of the bottom near the rear wall of the mounting base, removable vertical side walls, provided that the legs are made in the form of hollow parallelepipeds, the lower part of the legs is cut off at an acute angle defining the inclination of the mounting base to the long axes of the parallelepipeds, the upper part of the rear wall of the base is fitted with two triangular projections, the distance between which coincides with the distance between the inner surfaces of the cavities of the leg, the rear sides of the triangular projections are parallel to the axes of the legs, the left and the right edges of the tray mounting base are equipped with fixation elements for side walls installing on the mounting base and for horizontally fastening together at least two adjacent tray mounting bases to form a horizontal modular structure, and the legs of the tray and the upper part of the rear wall of the mounting base with triangular projections are fitted with elements of mutual fixation to each other to form a vertical modular structure.

2. The tray as set forth in claim 1, wherein the central part of the bottom of the mounting base narrow slots are made, and ribs are made on the inner side of the front and rear walls of the mounting base, provided that the width and the position of the clearances between the ribs correspond to the width of the slots in the bottom of the mounting base and their position so that the flat dividers with projections in the lower part can be inserted into them and fixed by these projections in the slots in the central part of the bottom of the mounting base.

3. The tray as set forth in claim 1, wherein a hole is made in the rare wall of the tray for tray hanging.

4. The tray as set forth in claim 1, wherein the inner-face of the right side wall of the tray is equipped with projections matching the shape of the grooves and notches in the right edge of the mounting base and meshing with these grooves and hollows.

5. The tray as set forth in claim 1, the inner-face of the left side wall of the tray is equipped with projections, grooves and hollows matching the shape of the grooves and notches in the left edge of the mounting base and meshing with these grooves and hollows.

6. The tray as set forth in claim 1, on the outside, the side walls of the tray are equipped with ribs and are closed with the covers matching the shape of the side walls of the tray and made of transparent material.

7. The tray as set forth in claim 1, wherein for interlocking of at least two trays to form a vertical modular structure, two projections are made on the rear sides of the triangular projections, matching to the shape and the size of the grooves on the lower part of the rear side of the leg, and facing surfaces of the triangular projections at the upper part of the rear wall are equipped with the spring-loaded circular clamps, matching the size of the circular holes on the facing surfaces of the parallelepipeds of the legs.

8. The tray as set forth in claim 7, wherein, in addition it has a headpiece consisting of two hollow prisms connected by a wall on the side facing the front wall of the tray mounting base, and having cutouts on the inner sides of the prisms, matching the spring-loaded circular clamps on the triangular projections of the rear wall of the mounting base.

9. The tray as set forth in claim 1, wherein the front wall of the tray has a cover pivotally connected with the mounting base of the tray.

10. The tray as set forth in claim 9, wherein the cover to the front wall of the tray is made with a transparent material.

11. The tray as set forth in claim 1, wherein the front and the rare walls are equipped with the vertical reinforcement ribs on the outside.

12. The tray as set forth in claim 1, wherein the train is equipped with lighting.

* * * * *